US009938656B2

(12) United States Patent
Anderson

(10) Patent No.: US 9,938,656 B2
(45) Date of Patent: Apr. 10, 2018

(54) DRYER APPLIANCES AND METHODS FOR OPERATING SAME

(71) Applicant: General Electric Company, Schenectady, NY (US)

(72) Inventor: Timothy Lee Anderson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 425 days.

(21) Appl. No.: 14/683,194

(22) Filed: Apr. 10, 2015

(65) Prior Publication Data

US 2016/0298281 A1 Oct. 13, 2016

(51) Int. Cl.
*D06F 58/20* (2006.01)
*D06F 58/28* (2006.01)

(52) U.S. Cl.
CPC ..... *D06F 58/28* (2013.01); *D06F 58/20* (2013.01); *D06F 2058/2864* (2013.01)

(58) Field of Classification Search
None
See application file for complete search history.

(56) References Cited

U.S. PATENT DOCUMENTS 4,011,662 A * 3/1977 Davis ..... D06F 58/20 137/119.09
5,771,604 A 6/1998 Wunderlich et al.
6,637,127 B2 10/2003 Reede et al.
7,707,858 B2 * 5/2010 Jeon ..... D06F 25/00 68/20
7,870,799 B2 1/2011 Neumann
8,256,133 B2 9/2012 Asciolla et al.
8,786,454 B2 7/2014 Siddall
9,371,609 B2 * 6/2016 Anderson ..... D06F 58/28
2008/0005926 A1 * 1/2008 Goggin ..... D06F 58/20 34/605
2009/0151192 A1 * 6/2009 Nawrot ..... D06F 58/28 34/526
2010/0058611 A1 3/2010 Neumann
2012/0096739 A1 4/2012 Clark

FOREIGN PATENT DOCUMENTS

EP 1960727 8/2008
WO WO 2007/064814 6/2007

* cited by examiner

*Primary Examiner* — David J Laux
(74) *Attorney, Agent, or Firm* — Dority & Manning, P.A.

(57) ABSTRACT

Dryer appliances and methods for operating dryer appliances are provided. A method includes flowing internal air from a drum chamber through an outlet assembly of the dryer appliance, and selectively actuating a valve to flow external air to the outlet assembly of the dryer appliance from external to a cabinet of the dryer appliance. The method further includes alternately sensing open flow pressure values of the external air being flowed to the outlet assembly from external to the cabinet when the valve is open and closed flow pressure values of the external air being flowed to the outlet assembly from external to the cabinet when the valve is closed.

9 Claims, 6 Drawing Sheets

DRYER APPLIANCES AND METHODS FOR OPERATING SAME

FIELD OF THE INVENTION

The present subject matter relates generally to dryer appliances and associated methods, and more particularly to the use of valves and pressure sensors to diagnose restrictions in the dryer appliances.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, a blower (also known as an air handler) is utilized to flow the internal air from the vent duct to the exhaust duct. When operating, the blower may pull air through itself from the vent duct, and this air may then flow from the blower to the exhaust conduit.

One issue that exists with dryer appliances is the possibility of restrictions in, for example, the vent duct or exhaust conduit. Restrictions decrease the effective operating size of the passages through which air flows during operation, and can be caused by, for example, lint build-up or other impediments lodged in such passages. Restrictions can prevent proper airflow, thereby reducing drying of articles in the dryer appliances. In some cases, restrictions can cause damage to dryer appliances, and can even result in fires. Accordingly, the ability to diagnose restrictions is of upmost importance.

Attempts have been made to diagnose restrictions in dryer appliances. However, typically known attempts generally require substantial additional hardware to be included in the dryer appliance, which can be costly. Further, many known attempts have proven to be ineffective or inaccurate.

Accordingly, improved dryer appliances and methods for diagnosing restrictions in dryer appliances are desired. In particular, dryer appliances and methods that provide inexpensive and effective restriction monitoring would be advantageous.

BRIEF DESCRIPTION OF THE INVENTION

In accordance with one embodiment of the present disclosure, a dryer appliance is provided. The dryer appliance includes a cabinet defining an interior, and a drum positioned within the interior, the drum defining a chamber for receipt of articles for drying. The dryer appliance further includes an outlet assembly positioned within the interior, the outlet assembly including a vent duct and an exhaust conduit in fluid communication with the vent duct, wherein internal air flows from the chamber through the vent duct to the exhaust conduit. The dryer appliance further includes a valve selectively operable to flow external air to the vent duct from external to the cabinet, and a pressure sensor positioned within the interior and operable to sense pressure values of the external air being flowed to the outlet assembly. Selective operation of the valve causes the pressure sensor to alternately sense open flow pressure values and closed flow pressure values.

In accordance with another embodiment of the present disclosure, a method for operating a dryer appliance is provided. The method includes flowing internal air from a drum chamber through an outlet assembly of the dryer appliance, and selectively actuating a valve to flow external air to the outlet assembly of the dryer appliance from external to a cabinet of the dryer appliance. The method further includes alternately sensing open flow pressure values of the external air being flowed to the outlet assembly from external to the cabinet when the valve is open and closed flow pressure values of the external air being flowed to the outlet assembly from external to the cabinet when the valve is closed.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
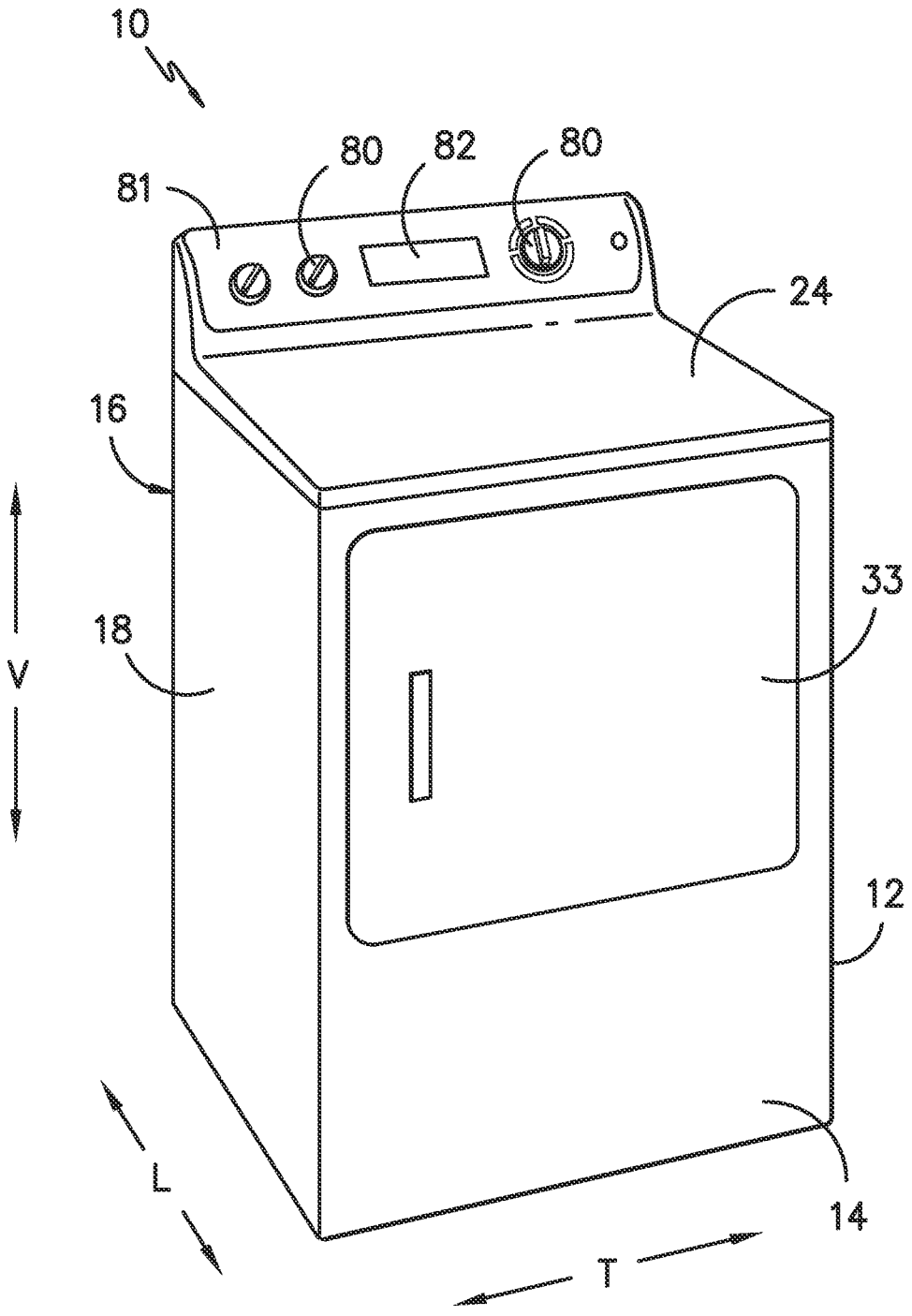
FIG. 1 provides a perspective view of a dryer appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
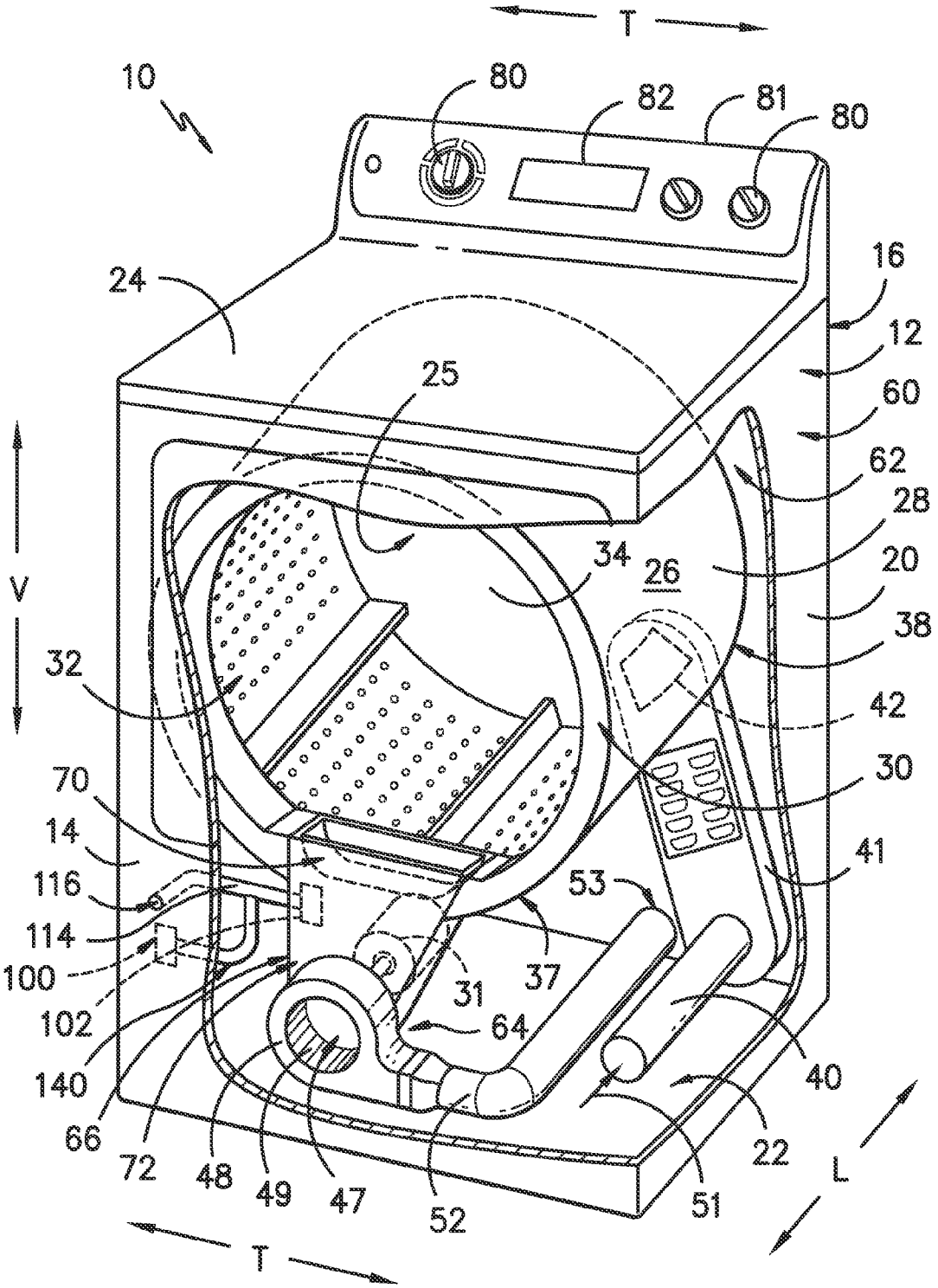
FIG. 2 provides a perspective view of the dryer appliance of FIG. 1 with portions of a cabinet of the dryer appliance removed to reveal certain components of the dryer appliance.
Figure 3:
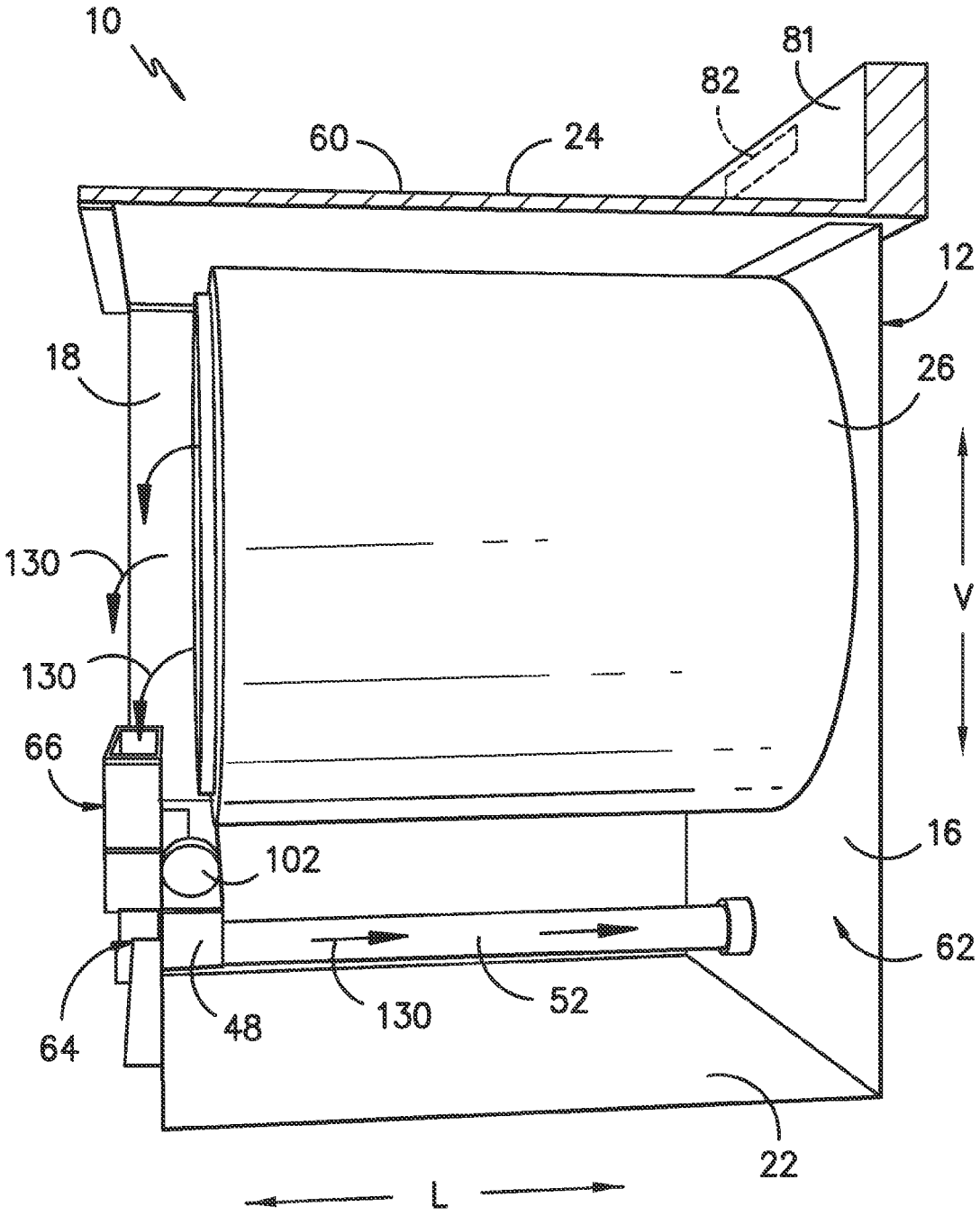
FIG. 3 provides a side schematic view of various components of a dryer appliance in accordance with one embodiment of the present disclosure.
Figure 4:
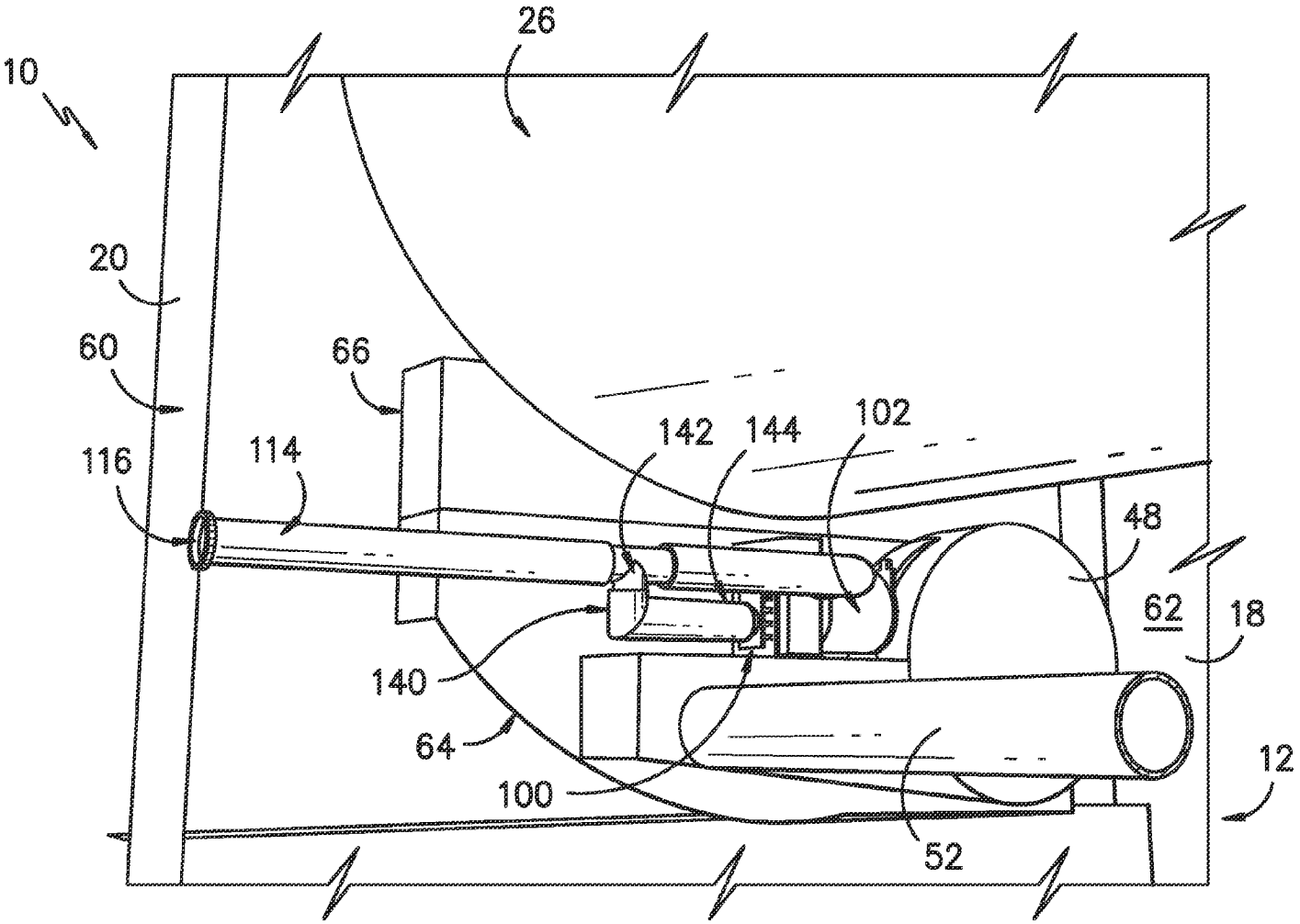
FIG. 4 is a rear perspective view of various components of a dryer appliance in accordance with one embodiment of the present disclosure.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of the cabinet 12 and an interior 62 of the cabinet. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the lateral direction L. In exemplary embodiments the drum 26 is rotational. Alternatively, however, the drum 26 may be fixedly mounted within the interior 62.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. In alternative embodiments, entry 32 may be defined in top cover 24 and cylinder 28, and front wall 30 may be a generally solid wall.

A motor 31 may be in mechanical communication with an blower or air handler 48 such that motor 31 rotates a fan 49, e.g., a centrifugal fan, of air handler 48. Air handler 48 is configured for drawing air through chamber 25 of drum 26, e.g., in order to dry articles located therein as discussed in greater detail below. In alternative exemplary embodiments, dryer appliance 10 may include an additional motor (not shown) for rotating fan 49 of air handler 48 independently of drum 26.

Drum 26 may be configured to receive heated air that has been heated by a heating assembly 40, e.g., in order to dry damp articles disposed within chamber 25 of drum 26. Heating assembly 40 includes a heating element (not shown), such as a gas burner or an electrical resistance heating element, for heating air. As discussed above, during operation of dryer appliance 10, motor 31 rotates fan 49 of air handler 48 such that air handler 48 draws air through chamber 25 of drum 26. In particular, ambient air enters heating assembly 40 via an entrance 51 due to air handler 48 urging such ambient air into entrance 51. Such ambient air is heated within heating assembly 40 and exits heating assembly 40 as heated air. Air handler 48 draws such heated air through duct 41 to drum 26. The heated air enters drum 26 through an outlet 42 of duct 41 positioned at rear wall 34 of drum 26.

Within chamber 25, the heated air can remove moisture, e.g., from damp articles disposed within chamber 25. This internal air in turn flows from the chamber 25 through an outlet assembly 64 positioned within the interior 62. The outlet assembly 64 includes a vent duct 66 and an exhaust conduit 52. The exhaust conduit 52 is in fluid communication with the vent duct 66. During a dry cycle, internal air flows from the chamber 25 through the vent duct 66 to the exhaust conduit 52, and is exhausted from the exhaust conduit 52. As shown, the internal air can for example flow from the vent duct 66 through an exit conduit 47 defined in the vent duct 66 and air handler 48 to the exhaust conduit 52.

In exemplary embodiments, vent duct 66 can include a filter portion 70 and an exhaust portion 72. The exhaust portion 72 may be positioned downstream of the filter portion 70 (in the direction of flow of the internal air). A screen filter of filter portion 70 (which may be removable) traps lint and other particulates as the internal air flows therethrough. The internal air may then flow through the exhaust portion 72 and to the exhaust conduit 52, such as through the exit conduit 47.

After the clothing articles have been dried, they are removed from the drum 26 via entry 32. A door 33 provides for closing or accessing drum 26 through entry 32.

A cycle selector knob 80 is mounted on a cabinet backsplash 81 and is in communication with a processing device or controller 82. Signals generated in controller 82 operate motor 31 and heating assembly 40 in response to the position of selector knobs 80. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

It should be understood that, while FIGS. 1 and 2 illustrate embodiments wherein dryer assembly 10 is a horizontal axis dryer assembly, in other embodiments dryer assembly 10 may be, for example, a vertical axis dryer assembly or another suitable dryer assembly. In a vertical axis dryer assembly 10, for example, cylinder 28 of drum 26 may extend along the vertical axis V between rear wall 34 and front wall 30. Accordingly, the present disclosure is not limited to horizontal axis dryer assemblies. Rather, any suitable dryer assembly is within the scope and spirit of the present disclosure.

Referring now to FIGS. 2 through 6, dryer appliance 10 may further include various components for advantageously monitoring for and diagnosing restrictions during operation of the dryer appliance 10. Such components, which may include for example a valve and a single pressure sensor, may advantageously be relatively inexpensive to install and may provide relatively accurate restriction diagnosis. In particular, such components may monitor pressure levels within the dryer appliance 10 during operation, and may indicate the potential existence of a restriction when differences in the monitored restriction levels drop below a predefined threshold level. Once this occurs, operation of the dryer appliance 10 may cease and/or the user may be alerted of such potential restrictions.

Dryer appliance 10 may thus include a pressure sensor 100 and a valve 102, both of which may be in communication with and thus operable by the controller 82. Valve 102 may be selectively operable to flow external air (which is generally ambient air from external to the dryer appliance 10) to the outlet assembly 64 from external to the cabinet 12. In exemplary embodiments, valve 102 may be selectively operable to flow external air to the vent duct 66, such as to the exhaust portion 72, from external to the cabinet 12. As discussed herein, pressure sensor 100 may operate to sense the pressure of the external air being flowed to the outlet assembly 64 from external to the cabinet 12 i.e. when the external air is within the cabinet 12 between external to the cabinet 12 and the outlet assembly 64. In general, pressure sensor 100 may operate to sense open flow pressure values when the valve 102 is in an open position and external air is thus allowed to flow through the valve 102 to the outlet assembly 64 as well as closed flow pressure values when the valve 102 is in a closed position and external air is thus prevented from flowing through the valve 102 to the outlet assembly 64. Differentials between closed flow pressure values and open flow pressure values may be correlated to restrictions within the dryer appliance 10, and thus utilized to diagnose such restrictions.

Valve 102 in exemplary embodiment is a solenoid valve, although alternatively any suitable valve 102 is within the scope and spirit of the present disclosure. Valve 102 may include an inlet 110 and an outlet 112. External air may be flowed into the valve 102 through the inlet 110 thereof, and from the outlet 112 into the outlet assembly 64, when the valve 102 is in in an open position. For example, in exemplary embodiments as illustrated, a hose 114 may extend between the valve 102 and the external surface 60 (through one of the panels or cover forming the cabinet), such that an inlet 116 of the hose 114 is in fluid communication with the environment exterior to the appliance 10. The hose 114 may be in fluid communication with the valve 102 such that external air flows through the hose 114 to the valve 102. For example, an outlet 118 of the hose 114 may be connected to the inlet 110 of the valve 102. When valve 102 is in an open position, external air may flow into hose 114 through inlet 116, through the hose 114, from the hose 114 into the valve 102, and through the valve 102. The external air may then exit the valve 102 through outlet 112 into the vent duct 66.

Notably, in exemplary embodiments, the use of a low pressure zone 120 within the vent duct 66, such as within the exhaust portion 72 thereof, may eliminate the need for any blower, motor, fan, or other device to urge external air into an through valve 102 when in the open position. For example, the valve 102 may be at least partially disposed in the vent duct 66, such as within the exhaust portion 72 thereof. In particular, as illustrated, the outlet 112 of the valve 102 may be disposed in the vent duct 66. Accordingly, valve 102 may define a restriction section 122 of the vent duct 66. The restriction section 122 is generally a portion of the vent duct 66 having a reduced cross-sectional area relative to portions both upstream and downstream (in the flow direction of internal air through the vent duct 66) of that portion. Accordingly, the restriction section 122 creates a Venturi effect and resulting low pressure zone 120. The extension of the outlet 112 of the valve 102 into the vent duct 66 may block a portion of the cross-sectional area within a portion of the vent duct 66, thus effectively creating the restriction portion 122 and low pressure zone 120. The resulting Venturi effect and resulting low pressure zone 120 may cause external air to be urged into the vent duct 66 through valve 102 when in the open position and without the need for any other devices to aid such flow. Alternatively, however, a blower, motor, fan, or other device may be utilized to flow the external air into the vent duct 66 as required.

Figure 6:
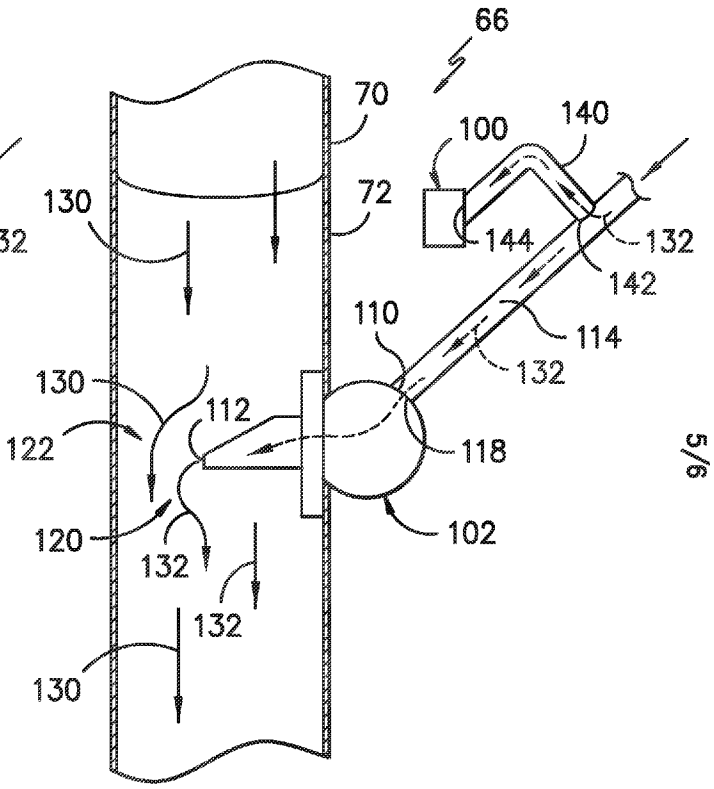
FIG. 6 is a cross-sectional view of a vent duct during operation of a dryer appliance and with a valve open in accordance with one embodiment of the present disclosure.
Figure 5:
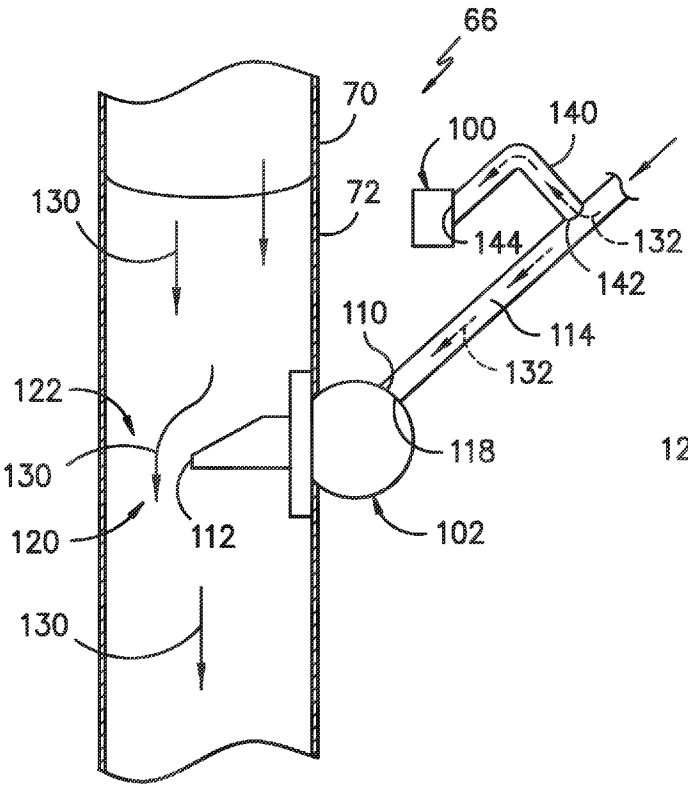
FIG. 5 is a cross-sectional view of a vent duct during operating of a dryer appliance and with a valve closed in accordance with one embodiment of the present disclosure.

FIG. 5 illustrates an example of the flow 130 of internal air through vent duct 66 during a dry cycle with the valve 102 in a closed position. FIG. 6 illustrates an example of the flow 130 of internal air and the flow 132 of external air through the vent duct 66 during a dry cycle with the valve 102 in an open position.

As discussed, pressure sensor 100 may generally sense pressure values of the external air being flowed to the outlet assembly 64 from external to the cabinet 12. Accordingly, pressure sensor 100 may be positioned in a flow path of the external air within the cabinet 12. In some embodiments, for example, pressure sensor 100 may be positioned within hose 114, such as between the inlet 116 and outlet 118 thereof. In other embodiments, as shown, a secondary hose 140 may flow external air to the pressure sensor 100. Secondary hose 140 may extend between the hose 114 and the pressure sensor 100, such that either the pressure sensor 100 is positioned within the hose 140 or the hose terminates at the pressure sensor 100 as shown. Pressure values, such as open flow pressure values and closed flow pressure values, may be sensed in the secondary hose 140, such as by the pressure sensor 100. Secondary hose 140 may generally be in fluid communication with the hose 114 and the pressure sensor 100 such that external air 132 flows from the hose 114 through the hose 140 to the pressure sensor 100. For example, as shown, an inlet 142 of the secondary hose 140 is connected to the hose 114 and an outlet 144 of the hose 140 is in contact with the pressure sensor 100. External air flowed from the hose 114 through the hose 140 may thus contact pressure sensor 100 at the outlet 144. As shown, in exemplary embodiments, secondary hose 140 connects to the hose 114 upstream of the valve 102 (in the direction of flow of the external air 132 through the hose 114) and thus between the inlet 116 and outlet 118 of the hose 114.

Pressure sensor 100 generally senses open flow pressure values when the valve 102 is in an open position and external air is thus allowed to flow through the valve 102 to the outlet assembly 64 as well as closed flow pressure values when the valve 102 is in a closed position and external air is thus prevented from flowing through the valve 102 to the outlet assembly 64. In general, the closed flow pressure values will be higher than the open flow pressure values. The presence of a restriction in the dryer appliance 10, however, may increase the open flow pressure values. Accordingly, the presence of a restriction in a dryer appliance 10 may result in a decrease in the differential pressure value (between an open flow pressure value and a neighboring closed flow pressure value). Such decreases in the pressure differential can thus be correlated to the existence and level of restrictions.

Any suitable pressure sensors 100 may be utilized in accordance with the present disclosure. For example, mechanical pressure sensors (which may for example utilize diaphragms), electrical pressure sensors, or electromechanical pressure sensors may be utilized.

Notably, in exemplary embodiments, only one pressure sensor 100 is required in a dryer appliance 10, with no additional pressure sensor included in the dryer appliance 10. The use of only one pressure sensor 100 simplifies and reduces the cost of the restriction diagnosis apparatus, while providing sufficient accuracy.

Figure 7:
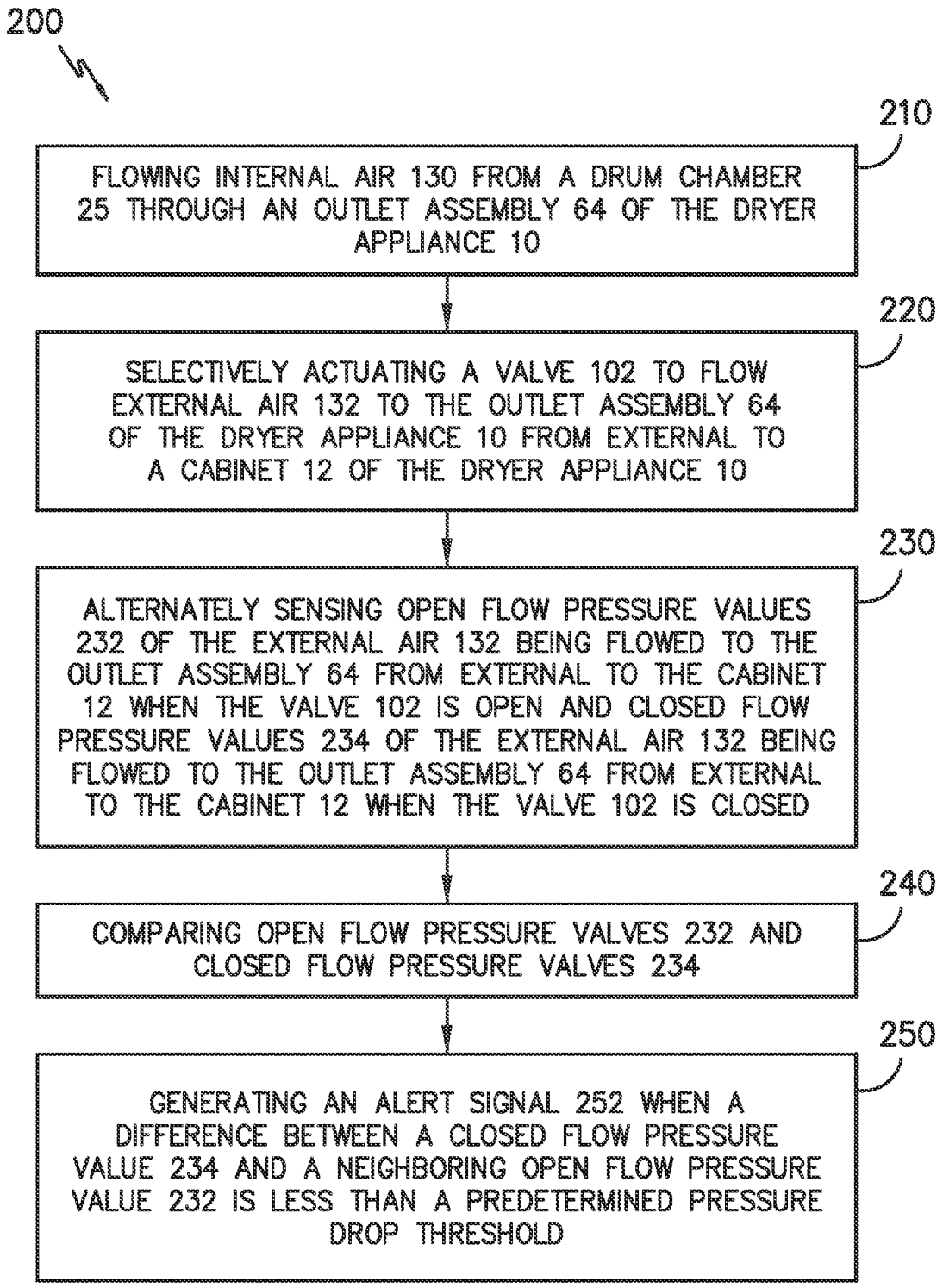
FIG. 7 is a flow chart of various steps of a method for operating a dryer appliance in accordance with one embodiment of the present disclosure.

The present disclosure is further directed to methods 200 for operating dryer appliances. In exemplary embodiments, controller 82 may, for example, be operable to perform the various steps of methods as disclosed herein. For example, controller 82 may, as discussed, be in communication with the pressure sensor 100 and valve 102, and may send signals to and receive signals from the pressure sensor 100 and valve 102. Controller 82 may further be in communication with other suitable components of the appliance 10 to facilitate operation of the appliance 10 generally. Referring to FIG. 7, a method may include, for example, the step 210 of flowing internal air from the chamber 25 through the outlet assembly 64 of the dryer appliance 10. Such internal air flow is facilitated by, for example, operation of the motor 31 and/or fan 49, such as during a dry cycle. Method 200 may further include, for example, the step 220 of selectively actuating valve 102 to flow external air through the outlet assembly 64 from external to the cabinet 12, as discussed herein. Method 200 may further include, for example, the step 230 of alternately sensing open flow pressure values 232 of the external air being flowed to the outlet assembly 64 from external to the cabinet 12 when the valve 102 is open and closed flow pressure values 234 of the external air being flowed to the outlet assembly 64 from external to the cabinet 12 when the valve 102 is closed, as discussed herein.

Further, method 200 may include the step 240 of comparing open flow pressure values 232 and closed flow pressure values 234. For example, each closed flow pressure value 234 may be compared to a neighboring open flow pressure value 232, i.e. the open flow pressure value 232 measured directly before or directly after that closed flow pressure value 234. In exemplary embodiments, for example, a difference may be calculated between the closed flow pressure value 234 and neighboring open flow pressure value 232.

Further, method 200 may include the step 250 of generating an alert signal 252 when a difference between a closed flow pressure value 234 and a neighboring open flow pressure value 232 is less than a predetermined pressure drop threshold. Such threshold may, for example, be correlated to the existence of a restriction of suitable size that such alert signal is desired. This size may, for example, be input be a user or predetermined for a dryer appliance 10. The alert signal may, for example, be sent to a user interface panel or indicator (such as a light) on the dryer appliance 10, or may alternatively be sent to a remote device such as a user's computer, cell phone, etc. Additionally or alternatively, operation of the dryer appliance 10 may be discontinued when a difference between a closed flow pressure value 234 and a neighboring open flow pressure value 232 is less than a predetermined pressure drop threshold. Operation may be discontinued by, for example, de-actuating the motor 31, fan 49, valve 102, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance, comprising:

a cabinet defining an interior;

a drum positioned within the interior, the drum defining a chamber for receipt of articles for drying;

an outlet assembly positioned within the interior, the outlet assembly comprising a vent duct and an exhaust conduit in fluid communication with the vent duct, wherein internal air flows from the chamber through the vent duct to the exhaust conduit;

a valve selectively operable to flow external air to the vent duct from external to the cabinet; and a pressure sensor positioned within the interior and operable to sense pressure values of the external air being flowed to the outlet assembly, wherein selective operation of the valve causes the pressure sensor to alternately sense open flow pressure values and closed flow pressure values.

2. The dryer appliance of claim 1, further comprising a hose extending between the valve and an external surface of the cabinet, the hose in fluid communication with the valve such that external air flows through the hose to the valve.

3. The dryer appliance of claim 2, further comprising a secondary hose extending between the hose and the pressure sensor, the secondary hose in fluid communication with the hose and the pressure sensor such that external air flows from the hose through the secondary hose to the pressure sensor.

4. The dryer appliance of claim 3, wherein the secondary hose connects with the hose upstream of the valve.

5. The dryer appliance of claim 1, wherein the vent duct comprises a filter portion and an exhaust portion downstream of the filter portion, and wherein the valve is selectively operable to flow external air to the exhaust portion from external to the cabinet.

6. The dryer appliance of claim 1, wherein the valve is a solenoid valve.

7. The dryer appliance of claim 1, wherein no additional pressure sensors are included in the dryer appliance.

8. The dryer appliance of claim 1, further comprising a controller in communication with the valve and the pressure sensor.

9. The dryer appliance of claim 8, wherein the controller is operable for:

controlling the flow of internal air from a drum chamber through the outlet assembly of the dryer appliance;

selectively actuating the valve to flow external air to the outlet assembly from external to the cabinet; and alternately sensing open flow pressure values of the external air being flowed to the outlet assembly from external to the cabinet when the valve is open and closed flow pressure values of the external air being flowed to the outlet assembly from external to the cabinet when the valve is closed.

* * * * *